US006132560A

United States Patent [19]

Gerstenkorn

[11] Patent Number: 6,132,560

[45] Date of Patent: Oct. 17, 2000

[54] ROTARY DRUM COOLER HAVING ADJUSTABLE LIFTERS

[75] Inventor: Ralph Gerstenkorn, Bellingham, Wash.

[73] Assignee: Atlantic Richfield Company, Chicago, Ill.

[21] Appl. No.: 09/152,209

[22] Filed: Sep. 11, 1998

[51] Int. Cl.[7] ..... C10B 39/00; C10B 39/12; C10B 1/00; F27B 7/14

[52] U.S. Cl. ..... 202/229; 202/227; 202/230; 110/246; 48/126; 48/187; 432/118

[58] Field of Search ..... 202/227, 229, 202/230, 262, 265; 201/39; 110/246, 275, 108–110; 48/126, 187–189; 432/118

[56] References Cited

U.S. PATENT DOCUMENTS

| | | | |
|---|---|---|---|
| 2,899,176 | 8/1959 | Francis et al. | 165/87 |
| 3,917,516 | 11/1975 | Waldmann et al. | 202/227 |
| 4,306,961 | 12/1981 | Taciuk | 208/390 |
| 4,307,520 | 12/1981 | Lutz | 34/108 |
| 4,557,804 | 12/1985 | Baumgartner et al. | 202/227 |
| 4,667,731 | 5/1987 | Baumgartner et al. | 165/88 |
| 4,747,913 | 5/1988 | Gerstenkorn et al. | 202/227 |
| 5,622,604 | 4/1997 | Gerstenkorn et al. | 202/227 |
| 5,868,256 | 2/1999 | Teppo | 209/173 |

FOREIGN PATENT DOCUMENTS

| | | |
|---|---|---|
| 2195424 | 4/1988 | United Kingdom . |

*Primary Examiner*—Marian C. Knode
*Assistant Examiner*—Alexa A. Doroshenk
*Attorney, Agent, or Firm*—Robert A. Yesukevich

[57] ABSTRACT

A rotary drum cooler having a shell for cooling particulate material (e.g. coke particles) wherein the volumetric capacity of the lifters within the shell which lift the material from the bottom of the shell to the exit thereof can be adjusted to thereby affect the exit parameters (e.g. temperature, particle size, etc.) of the cooled particulate material.

4 Claims, 3 Drawing Sheets

ROTARY DRUM COOLER HAVING ADJUSTABLE LIFTERS

DESCRIPTION

1. Technical Field

The present invention relates to a rotary drum cooler for cooling particulate or granular material and in one aspect relates to a rotary drum cooler for cooling particulate material such as petroleum coke wherein the volume of the lifters at the exit end of the cooler is adjustable to thereby control the temperature and size of the coke particles leaving the cooler.

2. Background

In certain commercial processes, particulate or granular material is treated at high-temperatures in a retort or the like to produce a desired end product. For example, petroleum coke is typically treated by heating crushed "green coke" in a calciner (e.g. rotary kiln or oven) to remove substantially all of the residual hydrocarbons from the coke thereby producing "calcined coke" (i.e. substantially pure carbon). Since the temperatures in these calciners reach extremely, high-temperatures (e.g. 2000° F. or greater), the particles of the calcined coke are usually white-hot and glowing as they exit from the calciner. The crushed coke must then be cooled before it undergoes further handling.

As is known in the art, rotary drum coolers (often referred to as "coke cooling rotors", these terms being used interchangeably herein) are commonly used for this purpose. Basically, a rotary drum cooler or coke cooling rotor is comprised of a shell (also sometimes referred to as the "drum" or "rotor"; also used interchangeably herein) which rotates within a housing which, in turn, has a water-bath in the bottom thereof. The hot coke enters one end of the drum or shell and the rotation of the shell causes the coke to move towards the other end therethrough.

As the coke moves through the shell, it comes into contact with "cooling pockets" which are formed or fitted within slots spaced along the length of the shell. As the shell rotates, each pocket (1) fills with water as the pocket passes through the water bath on the bottom of the housing; (2) picks up heat from the hot coke as the pocket is contacted by to the coke in the shell; (3) empties the water once it has been heated by the coke; and (4) refills with cold water to repeat the cycle. For examples of coke coolers of this general type, see U.S. Pat. No. 2,899,176 to Francis et al.; U.S. Pat. No. 3,917,516 to Waldmann et al.; U.S. Pat. No. 4,557,804 to Baumgartner et al.; U.S. Pat. No. 4,667,731 to Baumgartner et al.; and U.S. Pat. No. 4,747,913 to Gerstenkorn et al.

In some rotary coolers of this type, the shell usually include mechanical "lifters" at the exit end of the shell. These lifters are typically comprised of radially-spaced channels which are affixed to the exit end wall of the shell and extend from the side wall (i.e. relative bottom) of the shell into a centered, auger barrel which, in turn, carry the cooled particles out of the shell. Each lifter scoops up a volume of the cooled coke particles from the bottom of the shell as the shell rotates and continued rotation of the shell will cause the particles to be conveyed through the channel of the lifter into an auger barrel which, in turn, carries the particles out of the shell.

In known prior-art lifters of this type, once a lifter has been assembled into the shell of the cooler, the volume of cooled particles which that particular lifter will pick up and convey to the auger barrel is fixed and can not be adjusted. This is important since, at a fixed flow rate of coke through the shell, the volumetric capacity of the lifters control various parameters of the exiting, cooled coke particles.

For example, if the lifters are sized to pick up relatively less coke particles from the bottom of the shell on each rotation of the shell, the level of particles in the shell will rise and the residence time for the particles within the shell increases. An increase in residence time will result in a decrease of the temperature of the coke particles leaving the shell (i.e. cooler particles), as well as a smaller particle size due to a "ball mill" effect. On the other hand, if the lifters are sized to pick up relatively more coke particles on each rotation, the coke level will decrease resulting in an increase of the temperature of the "cooled" coke particles leaving the shell and a larger particle size.

Accordingly, it is desirable to be able to adjust the volumetric capacity of the lifters of a particular cooler so that different coolers do not have to be used to produce a desired cooled product when run conditions for a particular cooling operation change.

SUMMARY OF THE INVENTION

The present invention provides a rotary drum cooler for cooling particulate material (e.g. coke particles) wherein the volumetric capacity of the lifters can be adjusted to thereby affect the exit parameters (e.g. temperature, particle size, etc.) of the cooled particulate material.

More specifically, the present invention provides a rotary drum cooler for cooling particulate material comprised of a housing having a bath of cooling liquid in the lower end thereof. An elongated shell is rotatably mounted in said housing and has an inlet at one end for receiving said particulate material and an exit (e.g. auger barrel) at the other end through which said particulate material is removed after it has passed through said shell. At least one lifter (e.g. four, radially-spaced lifers) are affixed within said shell at the other end for lifting said particulate material from the bottom of said shell to said auger barrel with each lifter having a means for adjusting the volumetric capacity of the lifter.

Basically each lifter is comprised of a channel which is secured to the inside of the exit end of said shell and which extends from the bottom of the shell to said exit with the channel having an outlet opening therein (the size of which determines the volumetric capacity of the lifter) and a means for opening and closing this outlet in said channel to adjust the volumetric capacity of the lifter.

Preferably, each channel is comprised of a first member of angled metal (e.g. steel bent at a 90° angle) which extends from the auger barrel to a point near the bottom of said shell. One leg of the first member is affixed to said end-wall of the shell by welding or the like while the other leg of the first member defines one wall of the channel. A second member of angled metal is aligned with the first member and extends from the end fo the first member (i.e. the point near the bottom) to the bottom (i.e. side-wall) of said shell. One of the legs of the second member is affixed to the end-wall of the shell with the other leg of the second member being inverted with respect to the other leg of the first member. It is this break in the channel wall between the first member and the bottom of the shell that forms the outlet in the channel.

A plate is positioned at the outlet in the channel and is adapted to move upward or downward with respect to the bottom of the channel to adjust the size of the outlet. Means are provided for securing the plate in an adjusted position across the outlet in the channel, e.g. aligned openings in said plate and the inverted leg of the second member and a bolt extending through said aligned openings for securing the plate in a fixed position.

BRIEF DESCRIPTION OF THE DRAWINGS

The actual construction, operation, and apparent advantages of the present invention will be better understood by referring to the drawings which are not necessarily to scale and in which like numerals identify like parts and in which.

DETAILED DESCRIPTION OF THE INVENTION

Figure 1:
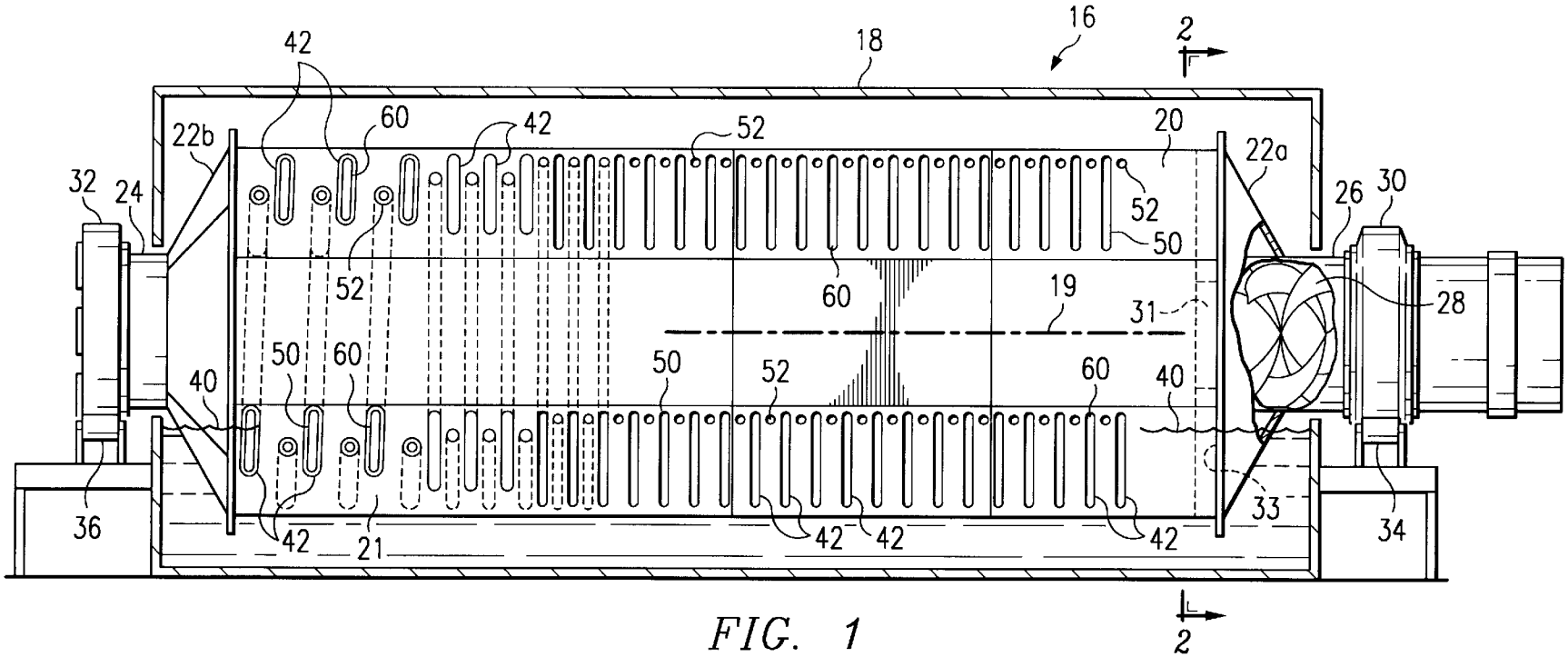
FIG. 1 is an elevational view, partly in section, of a typical drum cooler in accordance with the present invention.

Referring now to FIG. 1, there is illustrated a rotary drum cooler (e.g. coke cooling rotor) generally designated by the numeral 16. Rotary drum cooler 16 is comprised of an elongated drum or shell 20 which is rotatably mounted within a housing 18. As illustrated, shell 20 is octagonal in cross-section having side-walls 21 and being closed at either end by end caps 22*a*, 22*b*. An inlet duct 24 is connected to end cap 22*b* through which hot granulated or crushed material (e.g. coke particles, not shown) is passed from an inlet chute (also not shown) into drum 20. An outlet duct (auger barrel 26) having auger flights 28 secured therein passes is positioned on the shell's longitudinal axis and passes through the other end cap 22*a* to provide the outlet for the "cooled" particles, as will be understood in the art. The shell 20 is mounted for rotation about longitudinal axis 19 (FIG. 2)on tires 30, 32 or the like which, in turn, are supported on respective roller assemblies 34, 36, again as will be understood in the art.

Housing 18 has a bath of cooling liquid (e.g. water) 40 in the bottom or lower portion thereof. Housing may also include a suitable nozzle array (not shown) for spraying cooling fluid (e.g. water) onto the surface of shell 20 as is typical in coolers of this type. Shell 20 is partially immersed in the cooling bath 40 so that at least some of the cooling liquid (e.g. water) in bath 40 will be scooped-up by cooling pockets 42 in shell 20 as the drum rotates through the bath. Each cooling pocket is positioned within respective elongated slots 50 spaced along shell 20 and is retained therein by spot welding or the like.

Each pocket 42 is open at one end (e.g. opening 60, only a few numbered in FIG. 1 for clarity) to receive the cooling liquid and has a drain pipe at its other end which extends through a respective aperture 52 in the side-wall 21 on the other side of shell 20. Upon rotation of shell 20, water is picked up through the open end of each pocket 42 as it moves through bath 40 and then drains through its respective drain pipe after the water has been heat-exchanged with the hot coke within shell 20. The basic construction and operation of rotary shell cooler 16 as described to this point is known and is clearly disclosed and fully explained in U.S. Pat. No. 5,622,604 to Gerstenkorn et al., issued Apr. 22, 1997 which, in turn, is incorporated herein in its entirety by reference.

Certain rotary shell coolers of the type described above include "lifters" at the exit end of the shell which are mechanical devices which physically scoop up the cooled particles from the bottom of the shell and convey them into an axially-positioned, auger barrel which, in turn, carries the cooled particles out of the shell. A cooler of this type normally includes four lifters which are radially-spaced at 90° intervals about the exit end wall of the shell.

A typical lifter is formed by securing an angled piece of metal (e.g. "angle iron") to the exit end wall of the shell wherein the channel formed thereby extends along the end wall from the auger barrel to a respective side-wall of the shell. As the shell rotates, each lifter will move through the layer of coke particles on the bottom of the shell and will thereby scoop up a volume of particles into the channel of the lifter as that lifter moves through "bottom-dead center". The scooped-up particles will then move downward within the channel of the lifter under the influence of gravity and into the auger barrel as the shell and the attached lifter rotates 180° and through "top-dead center".

Figure 2:
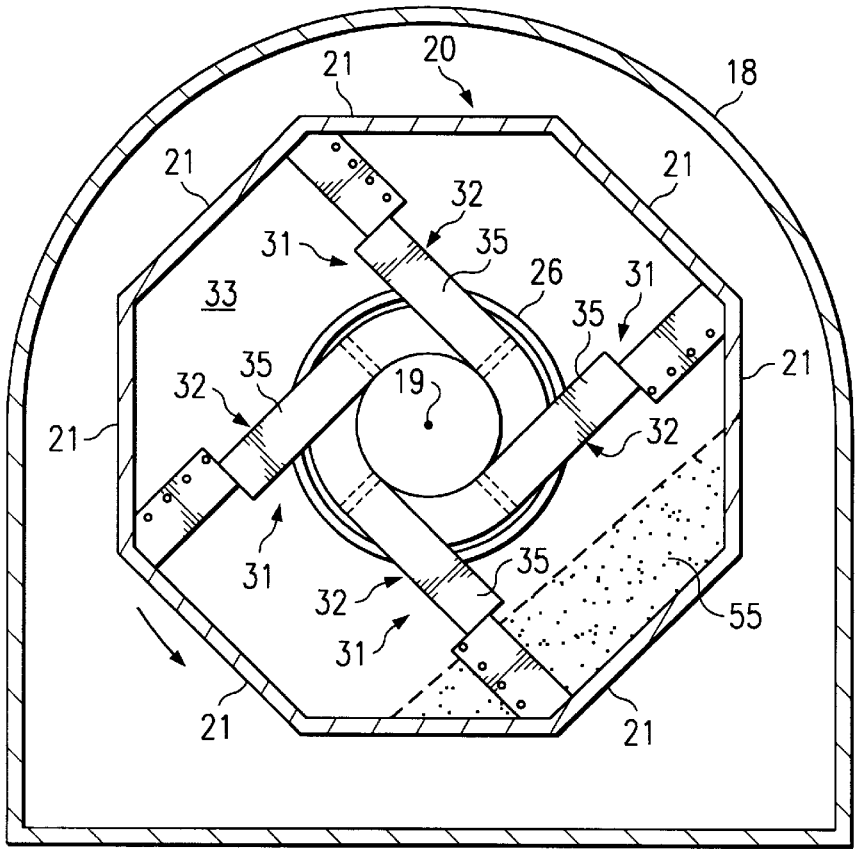
FIG. 2 is a sectional view taken along line 2—2 of FIG. 1.

Referring now more specifically to the drawings, FIGS. 2–6 illustrate the adjustable lifters 31 of the present invention. As best seen in FIG. 2, a plurality of lifters 31 (e.g. four) are radially-spaced at 90° intervals on end-wall 33 of shell 20. The construction of each lifter 31 is basically the same so only one will be described in detail. As illustrated, lifter 31 is comprised of an elongated, first member 32 comprised of a length of angled metal 32, e.g. "angle iron", which has one leg 34 welded or otherwise secured to end-wall 33 of shell 20. It should be recognized "angle iron", as used herein, is a generic term in the art and intended to cover all appropriate metals which can be used to form lifter 31; e.g. steel, alloys, etc.

The other leg 35 of member 32 along with leg 34 and end-wall 33 form a channel 36 which extends from auger barrel 26 to a point near a respective side-wall 21 of shell 20. A first leg 38 of a second, shorter member 37, also comprised of a length of angled metal, is welded or otherwise secured to end-wall 33 in an inverted position with respect to first member 32 (i.e. the other leg 39 of second member 37 extends downward instead of upward) and extends between the end of the first member 32 and side-wall 21. The end of second member 36 can be affixed to side-wall 21 by welding or the like. It can be seen for FIGS. 3 and 6, the leg 34 of first member 32 and the leg 38 of second member 37 form a continuous "bottom" for channel 36 which extends from end-wall 33 to auger barrel 26. However, by inverting second member 37, an outlet opening 41 is provided in channel 36 between the end of the first member 32 and end-wall 33, for a purpose explained below.

Figure 3:
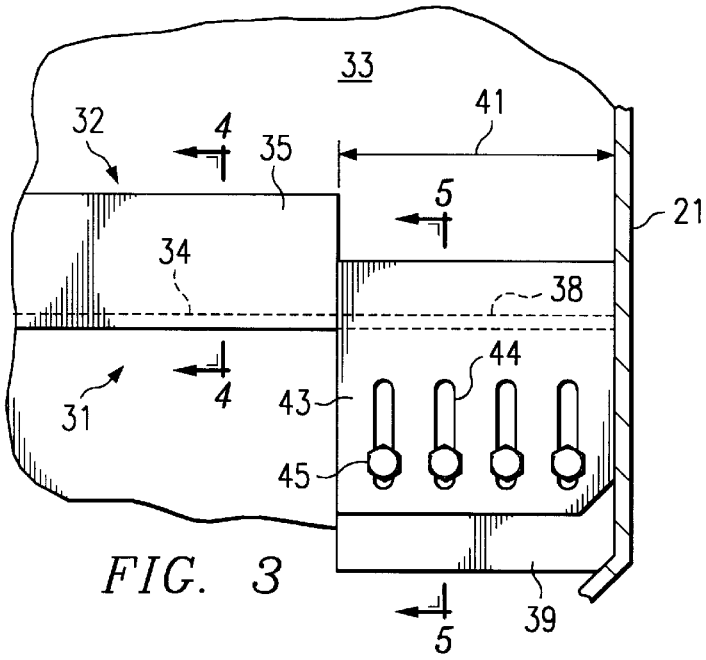
FIG. 3 is an enlarged view of a section, partly broken away, of one of the lifters mounted on the end wall of the drum cooler of FIG. 1.
Figure 4:
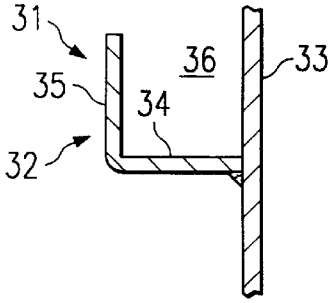
FIG. 4 is a sectional view taken along line 4—4 of FIG. 1.
Figure 5:
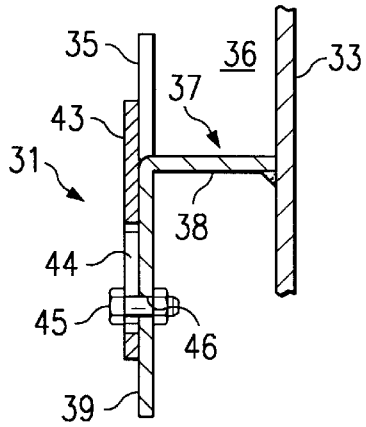
FIG. 5 is a sectional view taken along line 5—5 of FIG. 4.
Figure 6:
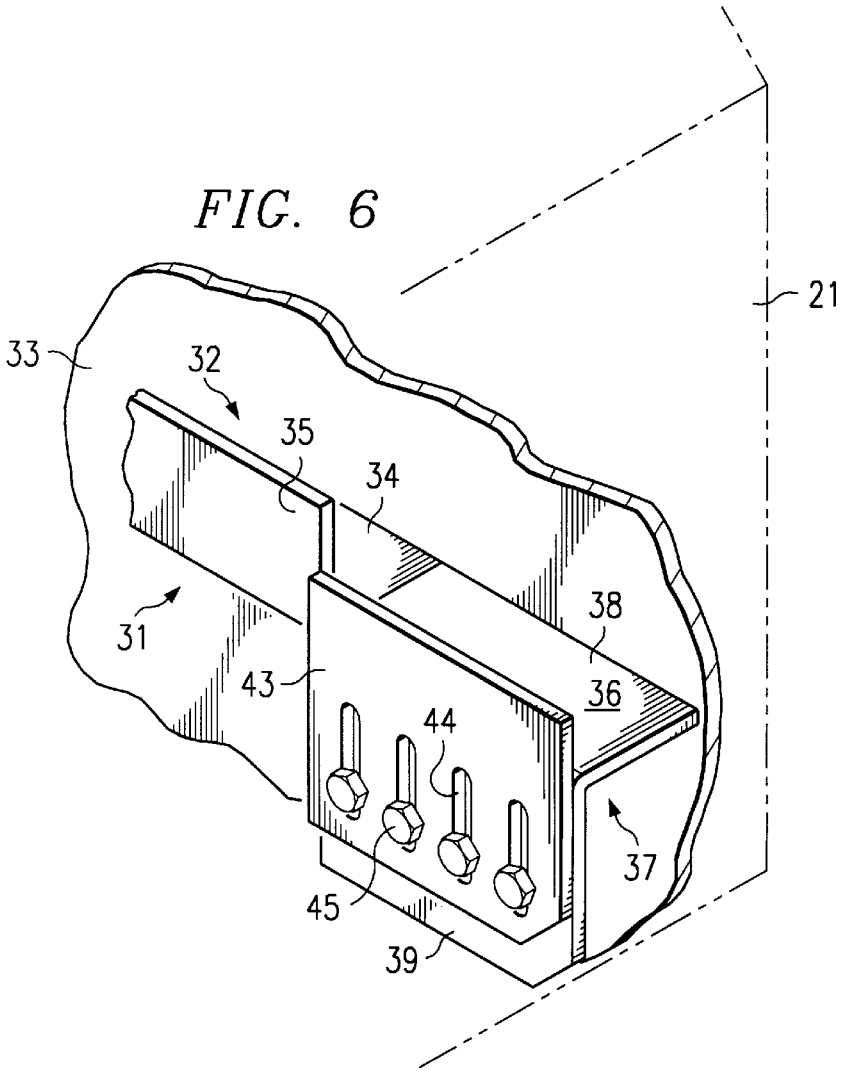
FIG. 6 is an enlarged, perspective view, partly broken away, of the lifter of FIG. 3.

A plate 43 is adapted to open outlet 41 when moved downward with respect to channel 36 (i.e. as viewed in FIG. 3) and to close the outlet when moved upward. As shown in FIGS. 3 and 6, plate 43 has a plurality of spaced, elongated slots 44 (four shown) each of which receive a bolt 45 or the like which, in turn, passes through a respective opening 46 in a support, i.e. leg 39 of second member 37. By loosing the bolts 45, plate 43 can be moved up or down to adjust the size of opening 41 for a purpose set forth below. While a specific construction of lifters 31 have been described, it should be recognized that other cut-and-weld techniques can be used to assembly the lifters without departing from the present invention. Also, other means can be used to adjust plate 43 with respect to outlet 41; e.g. slots 44 could be in support leg 39; individual holes in either plate 43 and/or in leg 39 can be provided which when aligned will affix plate 43 in a desired position; etc.

It can be seen that when plate 43 is all of the way up (i.e. the top of the plate will be aligned with the top of leg of first member 32), channel 36 of lifter 31 will be at its maximum volume. That is, as the shell 20 rotates, lifter 31 will pass through the layer 55 of coke particles (FIG. 2) and will scoop-up the maximum volume which can be held by channel 36 in lifter 31. As the lifter rotates through the top half of housing 18, the particles in channel 36 will begin to slid downward in the channel and into auger barrel 26. This operation is true for all four lifters 31 as they rotate through layer 55 and the operation continues as long as shell 20 is rotated.

By providing an outlet 41 in channel 36 which, in turn, can be adjusted, the amount of particles which can be picked up by a lifter during rotation through layer 55 can be increased or decreased. That is, when plate 43 is moved down, the volumetric capacity of channel 36 is decreased thereby causing less of the coke particles in the layer 55 to be picked up and conveyed to the auger barrel during a rotation of shell 20. As a result, the level of layer 55 tends to rise and the residence time of the particles within shell 20 increases. This increase in residence time will result in a decrease of the temperature of the particles leaving the shell, as well as a smaller particle size due to a "ball mill" effect.

On the other hand, if plate 43 is adjusted upward relative to the bottom of channel 36, the volumetric capacity of the lifter is increased thereby allowing the lifter to scoop-up a relatively larger amount of particles from the layer 55 during rotation. This results in a shorter residence time which, in turn, results in an increase of the temperature of the coke particles leaving the shell as well in a larger-sized particle.

By being able to adjust the volume of the lifters, a single rotary cooler can be more economically and efficiently used for a series of cooling operations in which the conditions of each operation may vary; i.e. amount of coke to be cooled, the particle size, etc. This is an important consideration since this type of coke cooler is very large and expensive and can not readily exchanged without a very significant cost in both money and downtime.

What is claimed is:

1. A rotary drum cooler for cooling particulate material, said cooler comprising:

a housing adapted to have a bath of cooling liquid therein;

an elongated shell rotatably mounted in said housing, said shell having an outer periphery and having an inlet at a first end for receiving said particulate material and an exit extending through an end-wall at a second end through which said particulate material is removed after it has passed through said shell;

a plurality of radially-spaced lifters within said shell affixed to said end-wall at said second end for lifting said particulate material from within said shell to said exit; each of said plurality of said lifters comprising:

a channel secured to the inside of said end-wall at said second end of said shell and extending from the outer periphery of said shell to said exit, said channel having an outlet opening adjacent said outer periphery through which particulate material can flow out of said channel; and means for adjusting said outlet opening in said channel whereby the volume of particulate material which can be carried within said channel can be varied.

2. The rotary drum cooler of claim 1 wherein said channel comprises:

a first member of angled metal having a first leg and a second leg, said first member extending from said exit to a point near said outer periphery of said shell, said first leg of said first member affixed to said end-wall whereby said first leg, said second leg, and said end wall define said channel; and a second member of angled metal having a first leg and a second leg, said second member being aligned with said first member and extending from said point near said outer periphery of said shell to said outer periphery of said shell, said first leg of said second member affixed to said end-wall with second leg of said second member being inverted with respect to said second leg of said first member whereby said outlet opening in said channel is defined between said point near said outer periphery of said shell and said outer periphery of said shell.

3. The rotary drum cooler of claim 2 wherein said means for adjusting said outlet in said channel comprises:

a plate positioned across said outlet and adapted to move upward or downward with respect thereto; and means for securing said plate in an adjusted position with respect to said outlet.

4. The rotary drum cooler of claim 3 wherein said plate has an opening therein and wherein said second leg of said second member has an opening therein and wherein said means for securing said plate comprises:

a bolt extending through said opening in said second leg of said second member and said opening in said plate.

* * * * *